US006177640B1

(12) United States Patent
Okabe et al.

(10) Patent No.: US 6,177,640 B1
(45) Date of Patent: Jan. 23, 2001

(54) COMPOSITE SWITCH

(75) Inventors: Kenji Okabe; Hirokatsu Omori, both of Tokyo (JP)

(73) Assignee: Sanwa Denshi Co., Ltd., Tokyo (JP)

( * ) Notice: Under 35 U.S.C. 154(b), the term of this patent shall be extended for 0 days.

(21) Appl. No.: 09/257,279

(22) Filed: Feb. 24, 1999

(30) Foreign Application Priority Data

Mar. 25, 1998 (JP) ..... 10-077822

(51) Int. Cl.[7] ..... H01H 25/04
(52) U.S. Cl. ..... 200/6 A
(58) Field of Search ..... 200/6 A

(56) References Cited

U.S. PATENT DOCUMENTS 2,747,035 * 5/1956 Hansen et al. ..... 200/6 A
5,068,499 * 11/1991 Kuratani ..... 200/6 A
5,406,040 * 4/1995 Johnson ..... 200/6 A

FOREIGN PATENT DOCUMENTS 62-62730 4/1987 (JP) .

* cited by examiner

*Primary Examiner*—Renee Luebke
(74) *Attorney, Agent, or Firm*—Notaro & Michalos P.C.

(57) ABSTRACT

A composite joystick switch has easy and positive operability. The joystick has a shaft and is provided with a plurality of switches operable by a user's fingers. A housing with a through-hole receives the joystick shaft and a plurality of second switches are provided around the through-hole outside or inside the housing. A guide plate is provided on the upper surface of the housing. A shell bearing supported in the housing receives a core bearing supported in the shell. Both are pivotally mounted in perpendicular directions. The joystick shaft extends through the guide slot in the shell bearing and is secured to the core bearing. A switch control is provided at a portion of the joystick shaft extending beyond the fulcrum of the joystick to turn on and off second switches. A seat is provided opposite to the switch control. A spring is provided around the joystick shaft between the seat and switch control to automatically return to its neutral position the joystick once tilted.

3 Claims, 7 Drawing Sheets

COMPOSITE SWITCH

BACKGROUND OF THE INVENTION

1. Field of the Invention

The present invention relates to a composite switch, and more particularly, to a composite switch best suitably usable to control a video game machine in playing a video game.

2. Description of the Prior Art

For example, the Japanese Publication of unexamined Utility Model Application No. 62-62730 discloses a switch assembly destined primarily for use with a TV game machine, comprising a joystick rotatable about its axis when the switch assembly is operated, swivel member supporting the joystick at the middle portion thereof freely tiltably, guide plate secured to the upper surface of the bearing member with a spacer provided between them to define a space between them and having formed in the center thereof a guide hole which receives the bottom end portion of the joystick and guides it in tilting directions, and a plurality of switches provided in the space between the guide plate and bearing member and secured to the lower surface of the guide plate, each of the switches having an actuating lever and the switches being disposed to selectively be pressed on the actuating lever thereof by the tilted joystick.

Recently, as more and more complicated TV games are developed for use in TV game machines, a joystick provided with a thumb switch or trigger switch which can be turned on and off by the user with the fingers has been demanded which could give a shock or vibration or similar to the finger of a user playing the game. Such a shock or vibration will effectively give greater fun to the game player. Under these circumstances, if the joystick is rotated about its axis when the user operates the switch assembly in playing a TV game, the position of the thumb and trigger switches will be varied. In this case, the thumb or trigger switch cannot be operated easily and positively, and harnesses led out from the thumb or trigger switch will possibly be broken.

SUMMARY OF THE INVENTION

Accordingly, the present invention has an object to overcome the above-mentioned drawbacks of the prior art by providing a composite switch having a joystick not rotatable about its axis while being operated, and which is designed for an easy and positive operability of joystick switches and a simpler structure.

The above object can be achieved by providing a composite switch comprising:

- a joystick having a shaft and provided therein a plurality of switches operable by the user with the fingers;
- a housing having formed in the center thereof a through-hole through which the joystick shaft extends;
- a plurality of switches provided around the through-hole outside or inside the housing;
- a guide plate provided on the upper surface of the housing and having a guide hole formed in the center thereof;
- a shell bearing supported in the housing pivotally in one direction and having a guide slot formed therein;
- a core bearing supported in the shell bearing pivotally in a direction perpendicular to the shell bearing and in which the joystick shaft extending through the guide slot in the shell bearing is secured;
- the joystick shaft extending upward and downward through the through-hole in the housing and guide hole in the guide plate;

- a switch control provided at a portion of the joystick shaft extending beyond the fulcrum of the joystick to turn on and off the switches in the joystick;
- a seat provided opposite to the switch control; and
- a spring provided around the joystick shaft between the seat and switch control to automatically return to its neutral position the joystick once tilted.

According to another aspect of the present invention, the shell bearing may be provided with support arms projecting therefrom and supported with the support arms born in the bearings in the housing pivotably in one direction and the core bearing may be provided with support pins and supported with the support pins born in bearing holes formed in the shell bearing pivotably in a direction perpendicular to the shell bearing.

According to still another aspect of the present invention, the housing may consists of upper and lower blocks which are superposed on each other, a switch base plate having a plurality of switches secured thereon may be provided under the lower block, and a mount plate be provided on the upper block to fixe itself to a control panel of a TV game machine.

These objects and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1:
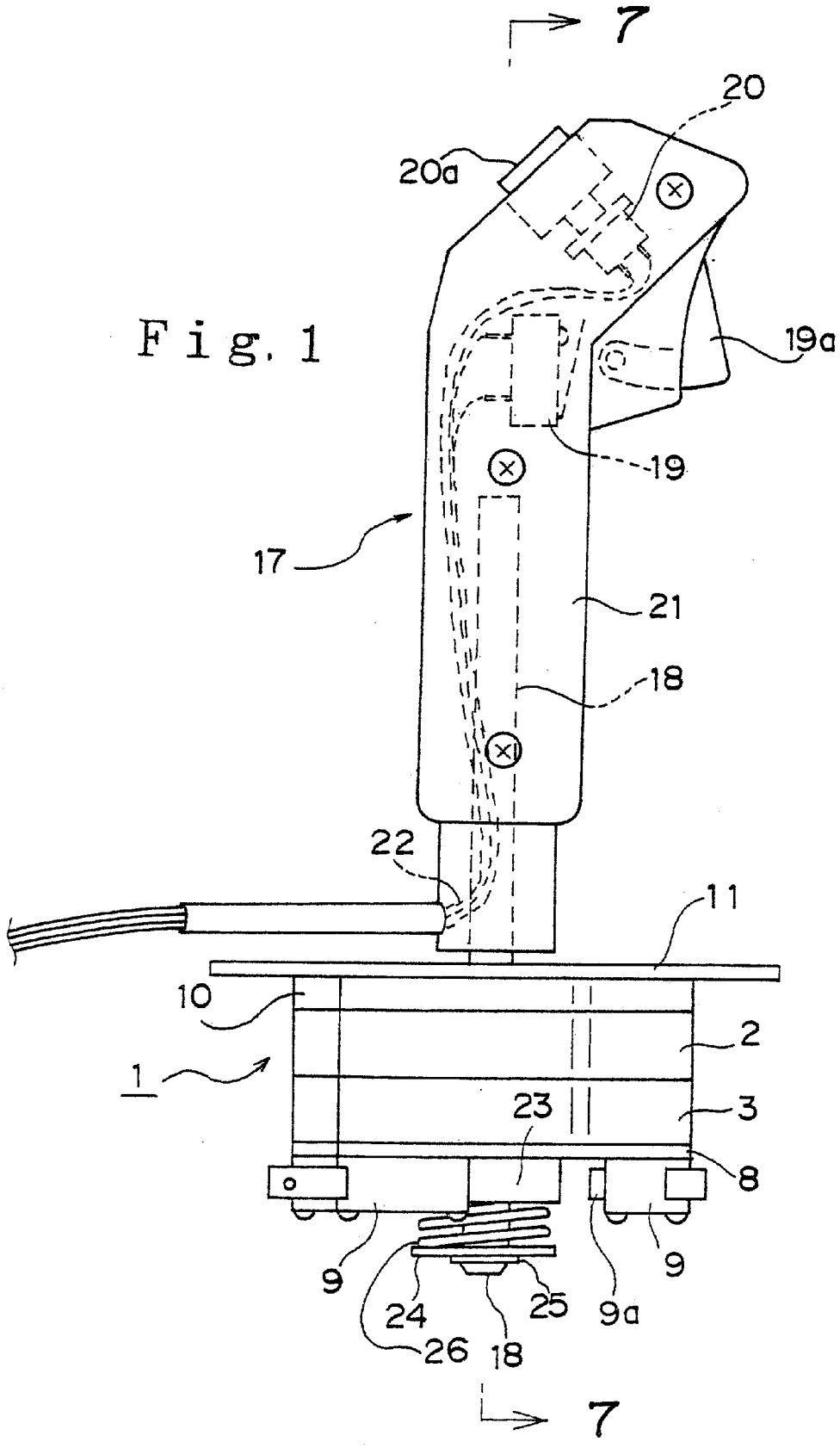
FIG. 1 is a front view of a composite switch according to the present invention.
Figure 2:
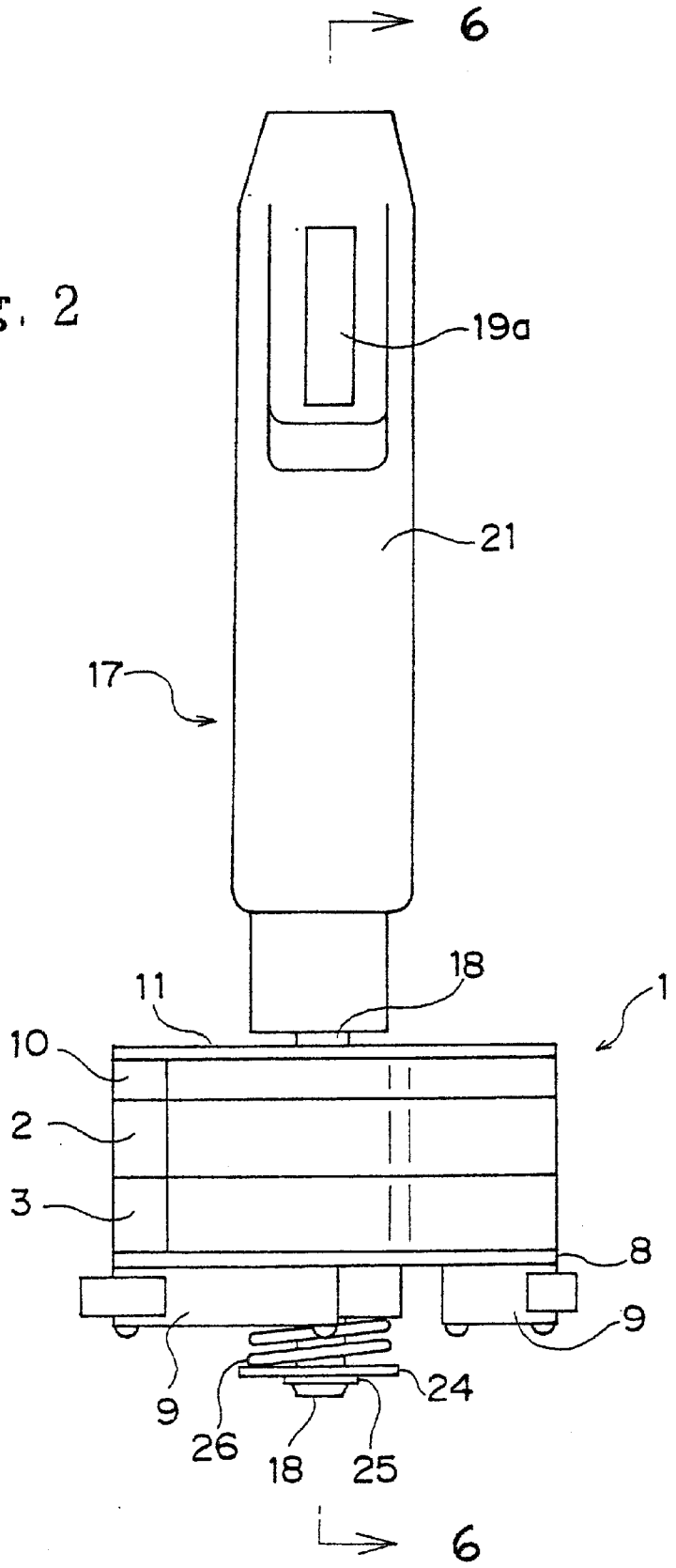
FIG. 2 is a side elevation of the composite switch in FIG. 1.
Figure 3:
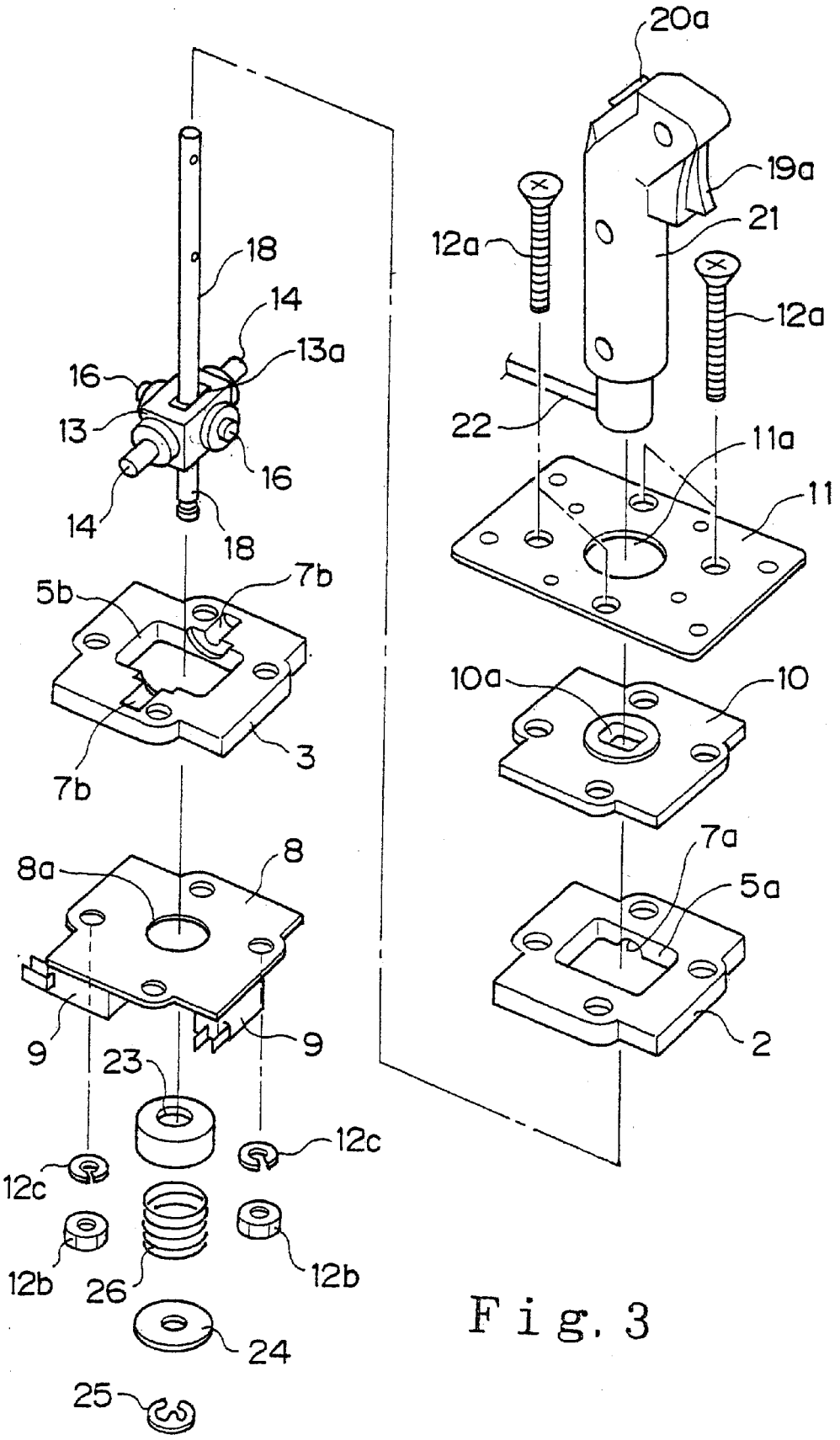
FIG. 3 is an exploded perspective view of the composite switch in FIG. 1.
Figure 4:
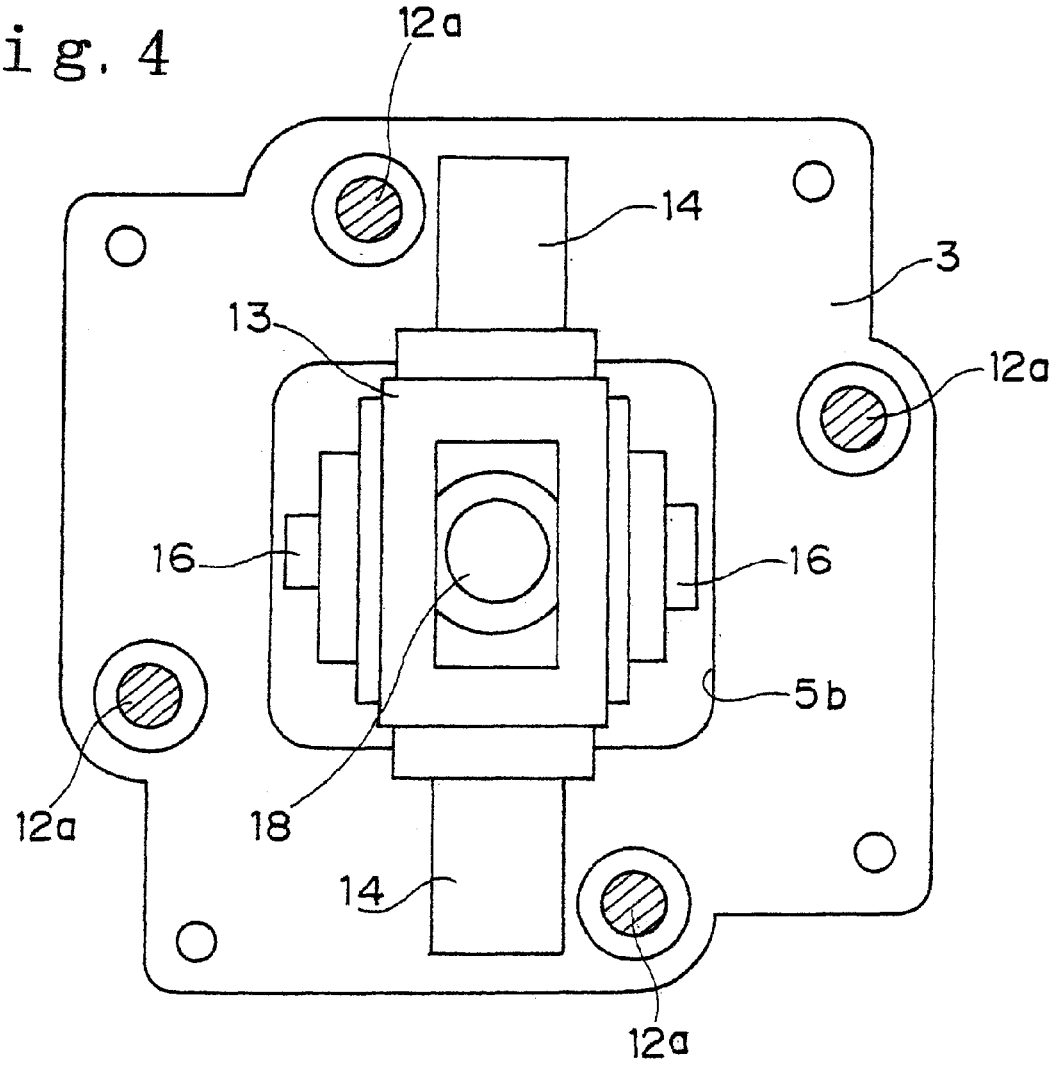
FIG. 4 is a plan view of the composite switch in FIG. 1, with the mount and guide plates omitted.
Figure 5:
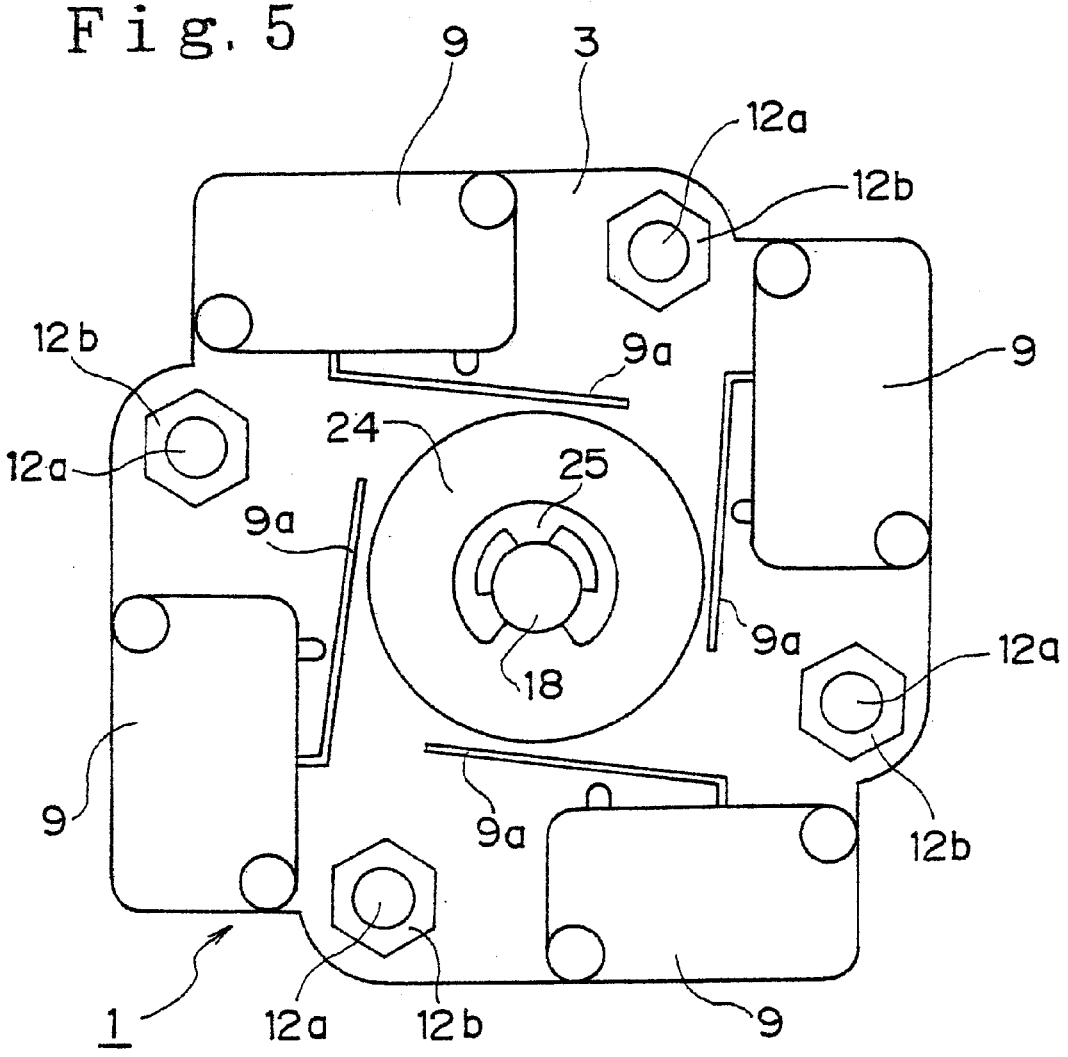
FIG. 5 is a bottom view of the composite switch in FIG. 1.
Figure 6:
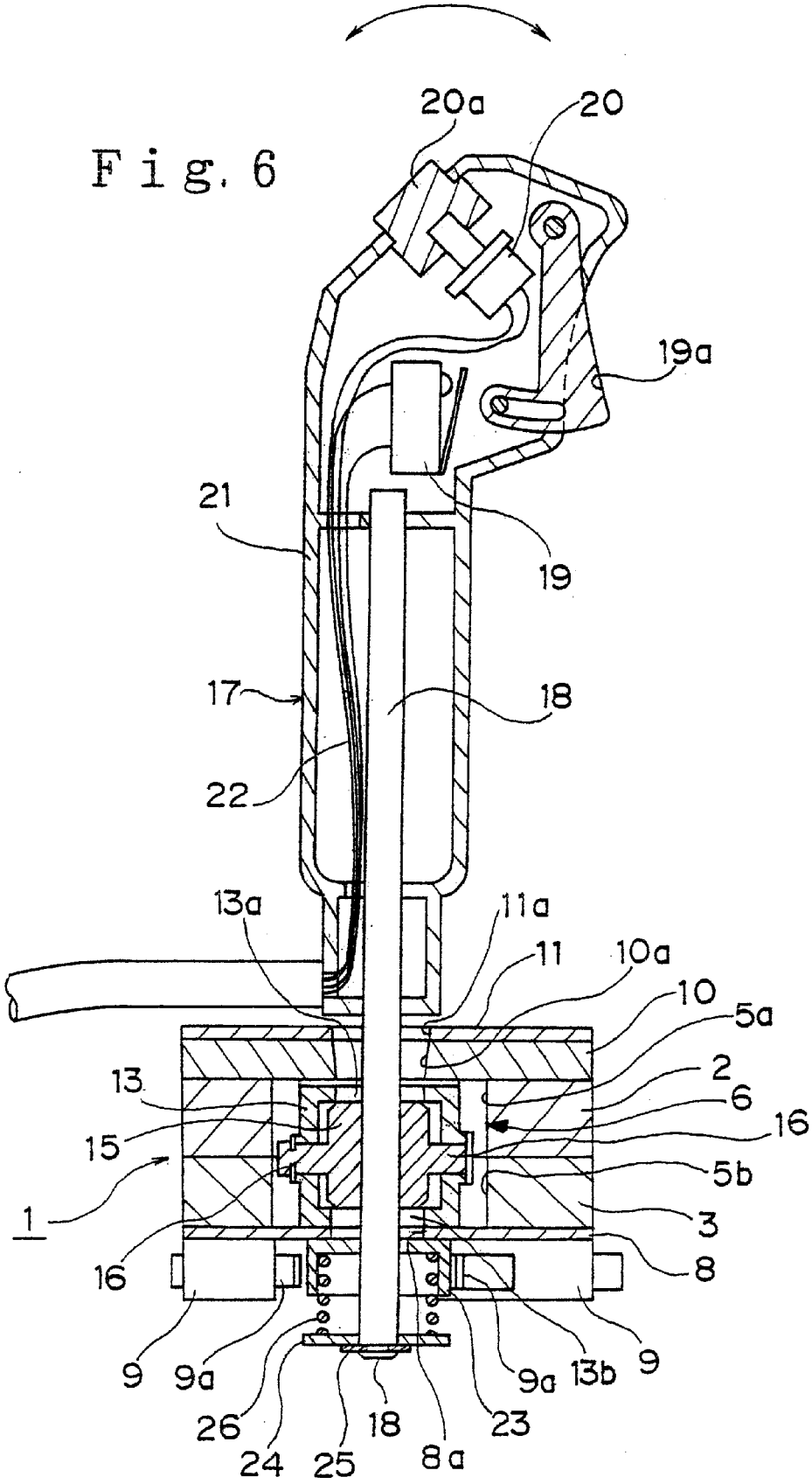
FIG. 6 is a sectional view taken along the line 6—6 in FIG. 2.
Figure 7:
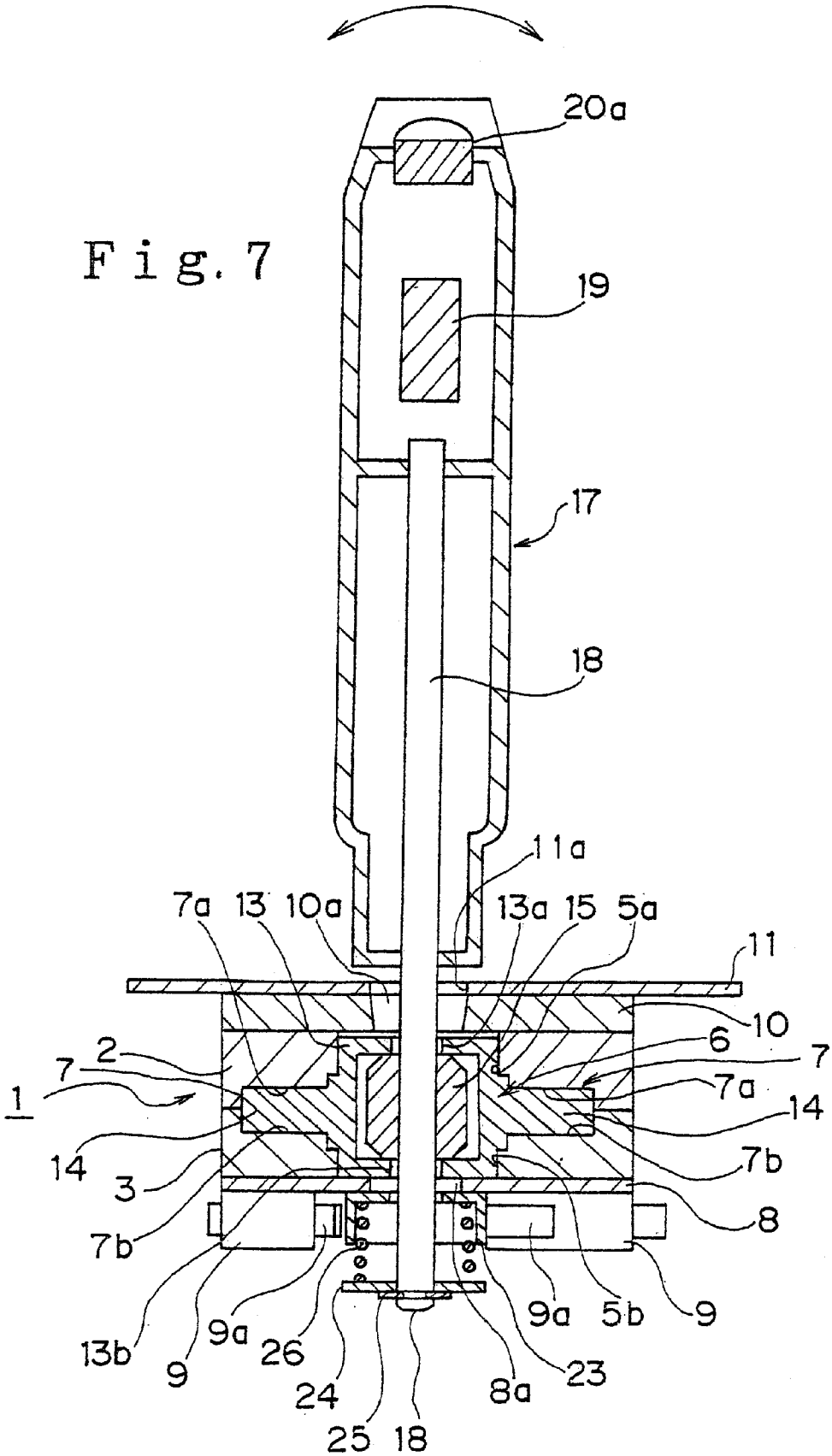
FIG. 7 is a sectional view taken along the line 7—7 in FIG. 1.

The accompanying drawings illustrate together one embodiment of composite switch according to the present invention. The composite switch comprises a housing generally indicated with a reference 1. The housing 1 consists of upper and lower blocks 2 and 3 each formed to have a generally rectangular flat shape. The upper and lower blocks 2 and 3 are opposite, and secured, to each other to form together the housing 1.

The upper and lower blocks 2 and 3 have formed generally in the center thereof through-holes 5*a* and 5*b*, respectively. When the upper and lower blocks 2 and 3 are superposed on, and secured to, each other in assembling the composite switch, the through-holes 5*a* and 5*b* define together a bearing compartment 6.

The upper block 2 has axially aligned concavities 7*a* formed transversely therein across the through-hole 5*a* ,and the lower block 3 has also axially aligned concavities 7*b* formed transversely therein across the through-hole 5*b*. The concavities 7*a* and 7*b* are formed to have a semi-circular cross section. When the upper and lower blocks 2 and 3 are superposed on, and secured to, each other in assembling the composite switch, the concavities 7*a* and 7*b* define together bearing holes 7.

There is provided on the bottom of the housing 1, namely, of the lower block 3 a switch base plate 8 having a through-hole 8*a* formed in the center thereof. Four switches 9 are secured around the through-hole 8*a* on the lower surface of the switch base plate 8. Each of the switches 9 has a switch actuating piece 9*a*. The switch actuating piece 9*a* of each switch 9 has a free end portion thereof deflected toward the through-hole 8*a*.

There is provided on the top of the housing 1, namely, of the upper block 2 a guide plate 10 having a guide hole 10*a* formed in the center thereof. Further a mount plate 11 is provided on the upper surface of the guide plate 10. The mount plate 11 has a through-hole 11*a* formed in the center thereof. The guide plate 10, housing 1 and switch base 8 are fixed to the mount plate with four bolts 12*a*, nuts 12*b* and washers 12*c*.

A hollow shell bearing 13 is lodged in the bearing compartment 6 in the housing 1. Support arms 14 are projected from opposite ends, respectively, of the shell bearing 13, and pivotally supported in the bearing holes 7, respectively. Thus, the shell bearing 13 is pivotable about the axis of the support arms 14. The shell bearing 13 has upper and lower elongated guide holes 13*a* and 13*b* formed therein.

A core bearing 15 having support pins 16 provided at opposite side thereof is supported inside the shell bearing 13 with the support pins 16 introduced in through-holes formed in the side walls of the shell bearing 13. Thus the core bearing is rotatable about the axis of the support pins 16 in a direction perpendicular to the shell bearing 13.

A joystick 17 is provided which comprises a shaft 18 extending through the upper and lower guide holes 13*a* and 13*b* of the shell bearing 13 and secured in the core bearing 15. The upper portion of the joystick shaft 18 extends upward through the through-hole 5*a* in the housing 1, guide hole 10*a* in the guide plate 10 and through-hole 11*a* of the mount plate 11 while the lower portion of the joystick shaft 18 extends downward through the through-hole 5*b* in the housing 1 and through-hole 8*a* in the switch base plate 8.

The joystick also comprises a split cover 21 in which the upper portion of the shaft 18, projecting through the through-hole 11*a* in the mount plate 11, extends and is secured. A switch 19 with a trigger lever 19*a* and a thumb switch 20 with a pushbutton 20*a* are provided inside the cover 21. The user can turn on and off these switches 19 and 20 by operating their respective trigger lever 19*a* and pushbutton 20*a* with the finger. There are laid inside the cover 21 harnesses 22 led out from these switches 19 and 20.

Furthermore, the joystick shaft 18 has fitted on the lower end portion thereof a disc-like switch control member 23 facing at the perimeter thereof the actuating pieces 9*a* of the switch 9 secured to the switch base plate 8. A seat 24 is fixed, with an E-ring 25, to the lowest end portion of the joystick shaft 18. A coil spring 26 is provided on the joystick shaft 18 and between the switch control member 23 and seat 24. The coil spring 26 is kept compressed between the member 23 and seat 24 to always act on the shaft 17 so that the joystick 17 once tilted is automatically returned to its home or neutral position.

The composite switch constructed as having been described in the foregoing functions as will be described below.

The shell bearing 13 and core bearing 15 are co-operative with each other to act as a universal bearing. Namely, when the joystick 17 is tilted in any direction within an angle of 360°, the shaft 18 of the joystick 17 is guided along the guide hole 10*a* in the guide plate 10 and causes the switch control member 23 to push the actuating piece 9*a* of a switch 9, related to the direction in which the joystick 17 is tilted. Thus the switch 9 is closed or turned on by the actuating piece 9*a*. When the joystick 17 is returned to its neutral position, the actuating piece 9*a* is also released and the switch 9 is thus opened or turned off.

As previously mentioned, the shell bearing 13 is allowed to pivot about its support arms 14 only in one direction inside the bearing compartment 6 in the housing 1. As mentioned previously, the shaft 18 of the joystick 17 is secured to the core bearing 15 inside the shell bearing 13. The core bearing 15 is allowed to pivot about its support pins 16 only in a direction perpendicular to the shell bearing 13. Thus, the joystick 17 is blocked from being rotated about its axis. Therefore, when the joystick 17 is tilted in any direction, the switch 19 and thumb switch 20 can always be operated accurately with the fingers kept applied on the trigger lever 19*a* and pushbutton 20*a*, respectively, provided on the joystick 17 (cover 21). That is to say, it is not necessary to relocate the fingers to follow up with the trigger lever and pushbutton as in the prior art.

What is claimed is:

1. A composite switch comprising:

a joystick having a shaft with a fulcrum and a first plurality of switches thereon, operable by fingers of a user;

a housing having formed in a center thereof a through-hole through which the joystick shaft extends;

a second plurality of switches provided around the through-hole and connected to the housing;

a guide plate provided on an upper surface of the housing and having a guide hole formed in a center thereof;

a shell bearing supported in the housing, the shell bearing being pivotal in one direction and having a guide slot formed therein;

a core bearing supported in the shell bearing, the core bearing being pivotal in a direction perpendicular to the pivotal direction of the shell bearing;

the joystick shaft extending through the guide slot in the shell bearing and being secured to the core bearing;

the joystick shaft extending upward and downward through the through-hole in the housing and guide hole in the guide plate;

a switch control provided at a portion of the joystick shaft extending beyond the fulcrum of the joystick to turn on and off the second plurality of switches;

a seat provided opposite to the switch control; and a spring provided around the joystick shaft between the seat and switch control to automatically return to its neutral position the joystick once tilted.

2. The composite switch as set forth in claim 1, wherein the shell bearing is provided with support arms projecting therefrom and supported with the support arms borne in the housing pivotably in one direction and the core bearing is provided with support pins and supported with the support pins supported in bearing holes formed in the shell bearing pivotably in a direction perpendicular to the shell bearing.

3. A composite switch comprising:

a joystick having a shaft with a fulcrum and a plurality of first switches operable by fingers of a user;

a housing consisting of upper and lower blocks which are superposed on each other and have formed in a center thereof through-holes through which the joystick shaft extends;

a switch base plate having formed therein a through-hole aligned with the through-holes in the housing and having a plurality of second switches secured thereon around the through-hole;

a guide plate provided on an upper surface of the housing and having a guide hole formed in a center thereof;

a mount plate provided on an upper surface of the housing and having formed therein a through-hole through which the joystick shaft is penetrated;

a shell bearing supported in the housing pivotally in one direction and having a guide slot formed therein;

a core bearing supported in the shell bearing, the core bearing being pivotal in a direction perpendicular to the pivotal direction of the shell bearing;

the joystick shaft penetrating through the guide slot in the shell bearing and being secured to the core bearing;

the joystick shaft extending upward and downward through the through-hole in the housing, guide hole in the guide plate, through-hole in the mount plate and through-hole in the switch base plate;

a switch control provided at a portion of the joystick shaft extending beyond the fulcrum of the joystick to turn on and off the second plurality of switches;

a seat provided opposite to the switch control; and a spring provided around the joystick shaft between the seat and switch control to automatically return to its neutral position the joystick once tilted.

* * * * *